United States Patent [19]

Anderson

[11] 4,273,265

[45] Jun. 16, 1981

[54] SAFETY DISPENSING SPOUT

[76] Inventor: Bazeel B. Anderson, 2233 Glenco Ter., Fort Worth, Tex. 76110

[21] Appl. No.: 159,200

[22] Filed: Jun. 13, 1980

Related U.S. Application Data

[63] Continuation of Ser. No. 51,995, Jun. 25, 1979, abandoned, which is a continuation of Ser. No. 848,496, Nov. 4, 1977, abandoned.

[51] Int. Cl.[3] ..... B67D 5/58; B67D 3/00

[52] U.S. Cl. ..... 222/189; 222/479; 222/484; 222/517

[58] Field of Search ..... 222/189, 479, 482, 484, 222/488, 517, 545, 556, 568; 169/48-50

[56] References Cited

U.S. PATENT DOCUMENTS

| | | | |
|---|---|---|---|
| 1,193,157 | 8/1916 | Krause et al. | 222/479 X |
| 1,907,976 | 5/1933 | Jones | 222/189 X |
| 2,329,716 | 9/1943 | Johnson | 222/488 |
| 2,365,695 | 12/1944 | Grice | 222/488 X |
| 3,054,537 | 9/1962 | Doyle | 222/556 |
| 3,173,587 | 3/1965 | Stearns | 222/525 X |
| 3,469,747 | 9/1969 | Richmond, Jr. | 222/189 X |
| 3,901,417 | 8/1975 | Schieman | 272/479 |

FOREIGN PATENT DOCUMENTS

| | | | |
|---|---|---|---|
| 1083362 | 6/1954 | France | 222/556 |

*Primary Examiner*—Robert J. Spar
*Assistant Examiner*—Fred A. Silverberg
*Attorney, Agent, or Firm*—Wofford, Fails & Zobal

[57] ABSTRACT

A dispensing spout which may readily be coupled to the opening of a liquid container. The spout has a closure and a venting tube, the latter of which is adapted to be located in the container at a position to allow atmospheric air to flow into the container to facilitate dispensing of the liquid when the closure is opened for dispensing purposes.

5 Claims, 10 Drawing Figures

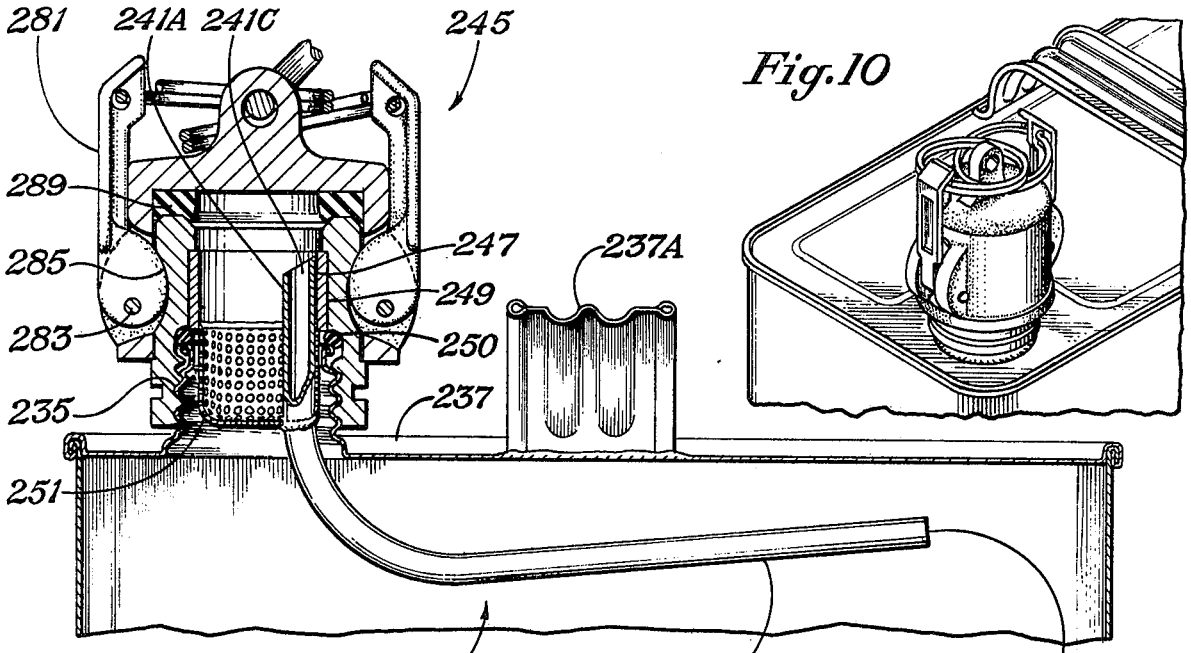
Fig.10
Fig.9
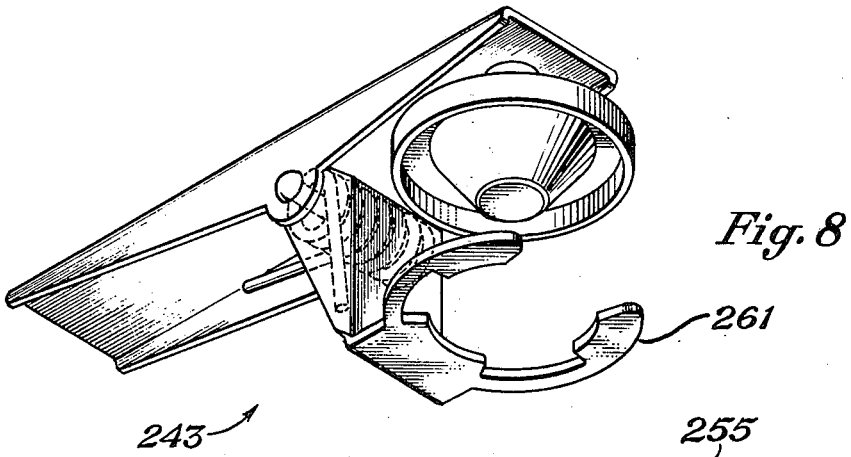
Fig. 8
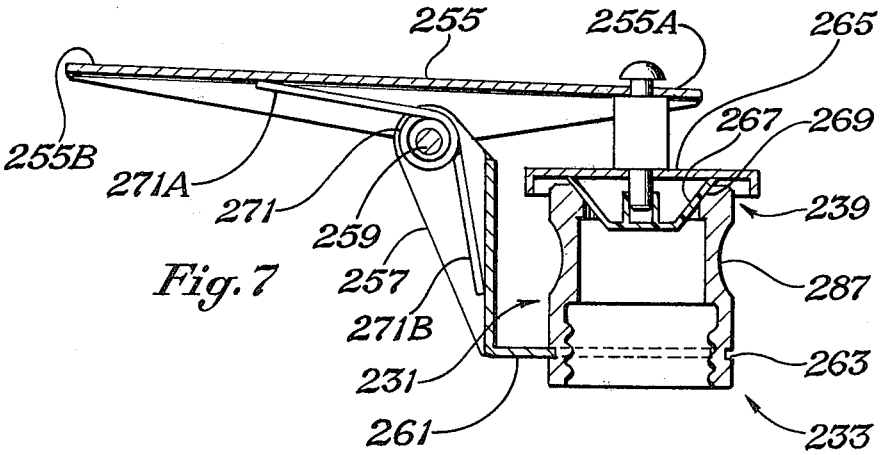
Fig. 7

SAFETY DISPENSING SPOUT

This is a continuation of application Ser. No. 51,995, filed June 25, 1979, now abandoned. Application Ser. No. 51,995 is a continuation of application Ser. No. 848,496, filed Nov. 4, 1977, now abandoned.

SUMMARY OF THE INVENTION

It is an object of the present invention to provide a dispensing spout which may be readily coupled to the opening of a liquid container to facilitate dispensing of liquid.

The spout comprises conduit means having a first end adapted to be coupled to the opening of a container and a dispensing end opposite said first end. A vent tube is provided having a first portion located in said conduit means and a second portion extending out of said first end to be located in the container when said first end of said conduit means is coupled to the opening of the container. Said second portion of said vent tube has an end adapted to be located in the container at a position spaced away from the opening and near the upper portion of the container when it is in a dispensing position. Movable means is provided for closing said conduit means when located in a first position.

In addition, control means is provided for moving said movable means away from said first position for opening said conduit means to allow liquid in the container to flow from said dispensing end of said conduit means when the container is located in a dispensing position. Said first portion of said vent tube has an opening adapted to be exposed to the atmosphere when said movable means is moved to open said conduit means thereby allowing air to flow into the container to facilitate the dispensing of the liquid.

BRIEF DESCRIPTION OF THE DRAWINGS

FIG. 7 is a further embodiment of the dispensing spout of the present invention with its vent tube removed;

FIG. 8 is an underside perspective view of the lid of FIG. 7 removed from the spout;

FIG. 9 illustrates the spout of FIG. 7 attached to a can and having its vent tube in place and a different type of lid attached to the spout; and FIG. 10 is a perspective view of the spout attached to a can and having the lid of FIG. 9 attached to the spout.

DETAILED DESCRIPTION OF THE INVENTION

Figure 1:
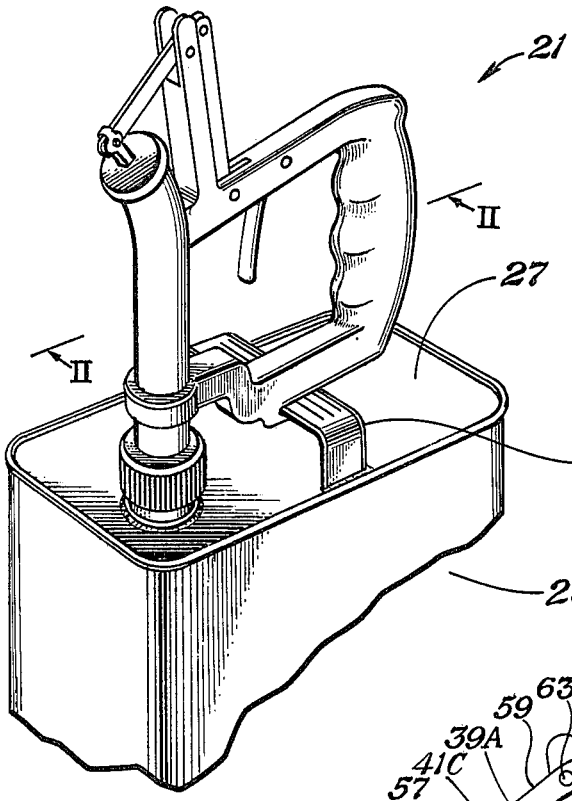
FIG. 1 illustrates one embodiment of the dispensing spout of the present invention attached to the opening of a liquid container.
Figure 2:
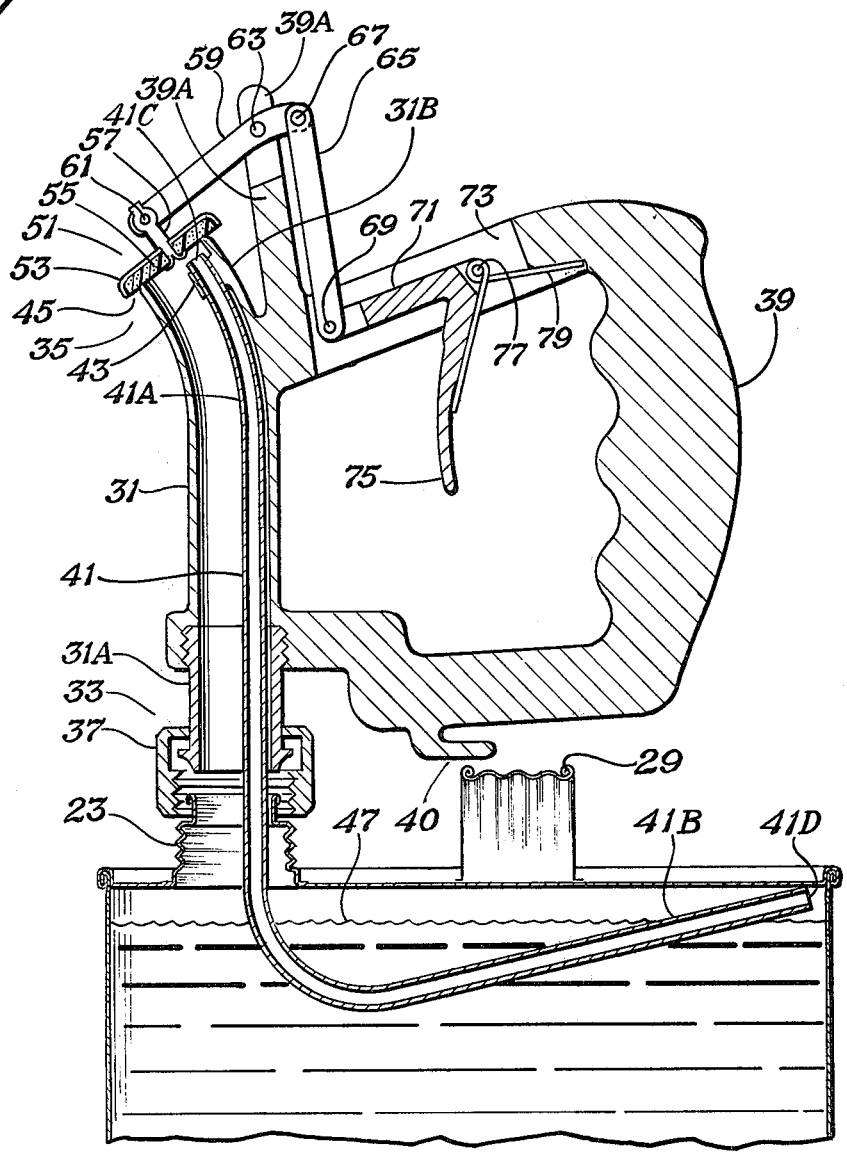
FIG. 2 is a cross-section of the spout of FIG. 1 taken along the lines 2—2 thereof.

Referring now to FIGS. 1 and 2, the dispensing spout shown therein is identified by reference numeral 21. It is adapted to be coupled to the threaded opening 23 of a conventional can or container 25 for holding liquid which may be flamable or non flamable, volatile or non volatile etc. The spout 21 is particularly adapted for use on cans or containers employed for holding a volatile liquid to vent the can during storage in the event of pressure build up. It is also constructed for use on cans having an opening 23 at one end of the top 27 and a U-shaped handle 29 attached to the can at the mid-portion of its top end. The can 25 may be a relatively small can of one or two gallon capacity.

The spout 21 comprises a conduit 31 having an end 33 adapted to be coupled to the opening 23 and an opposite dispensing end 35. End 33 comprises a fitting 31A threaded to conduit 31 and having a union joint 37 with female threads for attachment to the male threads of opening 23. Connected to the conduit 31 is a handle 39 having a lower tab 40 adapted to fit under the handle 29 of the can when union 37 is threaded to the opening 23 as seen in FIG. 1.

The spout 21 includes a vent tube 41 having a first portion 41A located in the conduit 31 and a second portion 41B extending out of the conduit 31 such that it may be located in the can when the spout 21 is coupled in place to the can. The vent tube portion 41A of the vent tube is held close to the wall portion 31B of the conduit by a tab 43 with its opening 41C located close to the edge of the dispensing end 35 of the conduit 31. The vent tube portion 41B extends generally transverse to portion 41A preferably forming an acute angle therewith such that its opening 41D will be located close to the top 27 of the can 25 when the spout 21 is coupled in place. Preferably, the opening 41D will be located such that it is above the liquid level, illustrated at 47, when the can is full.

A cover or lid 51 is provided for opening and closing the conduit 31. The lid 41 comprises a cup shaped member 53 having a plyable or flexible seal 55 for enaging the edge 45 of the conduit 31 when the lid 51 is in a closed position as shown in FIG. 2. Fixedly secured to the lid 51 is an arm 57 having an end pivotally coupled to a linkage 59 by pivot pin 61. Linkage 59 is pivotally coupled to a yoke 39A by pivot pin 63 and to a linkage 65 by pivot pin 67. Yoke 39A is an extension from the handle 39. Linkage 65 is pivotally coupled by pin 69 to a linkage 71 located in a slot 73 formed in the handle 39. A trigger member 75 is integral with linkage 71 and extends downward from the slot 73. Linkage 71 and trigger member 75 are pivotally coupled to the handle 39 by pin 77. By pulling the trigger member 75 to the right as seen in FIG. 2, the linkages act to move the lid 51 upward and clock wise as seen in FIG. 2 to open the conduit 31. When the tigger member 75 is released, a spring 79, extending around pin 77 and bearing against trigger member 75 and the handle 39, causes the linkages to move the lid 51 to a closed position. Thus the spring 79 normally maintains the lid 51 in a closed position.

When it is desired to dispense liquid from the can 25, the handle 39 may be gripped and the conduit 31 and hence the can 25 tilted to the left as seen in FIG. 2. At the same time, the trigger member 75 may be gripped to move the lid 51 to an open position. When the spout 21 and can 25 are tilted sufficiently, the liquid will flow from the container through the spout 21. The flow will be smooth since air will be drawn into the can through the vent tube 41 due to the slight vacuum created in the space in the can above the liquid level and in the tube 41 as the liquid is dispensed. The atmospheric air flowing out of the opening 41D will facilitate dispensing of the liquid. It has been found that the liquid will be dispensed more smoothly if the opening 41D is above the liquid level in the can. Moreover, the higher the opening 41D is relative to the dispensing end 35 of the conduit 31, the more smoothly the liquid is dispensed. Since the opening 41C of the tube 41 is located against the conduit wall 31B, it will be above the liquid in the conduit 31 as it is dispensed when the conduit 31 is tilted. Thus the liquid flowing out of the dispensing end 35 of the conduit 31 will not interfere with the flow of air into the vent tube 41 through its opening 41C.

If the can is used to store a volatile liquid, the spout 21 acts as a safety spout since a build up of pressure in the can will cause the lid 51 to open at a certain pressure level against the bias of the spring 79 to vent the can to the atmosphere thereby releasing the pressure.

Figure 3:
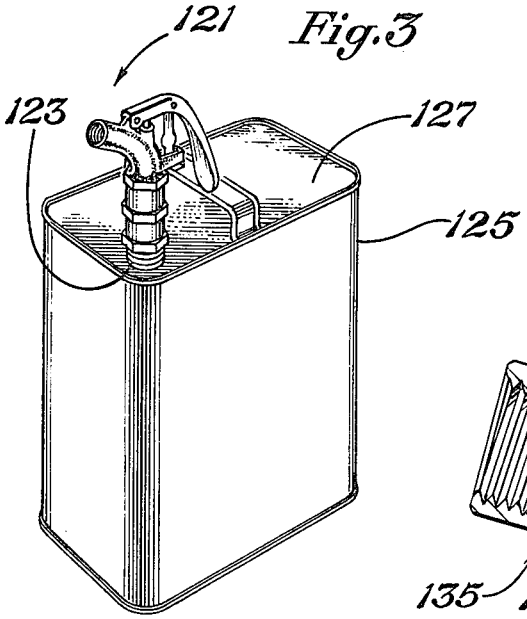
FIG. 3 is another embodiment of the dispensing spout of the present invention attached to the opening of a liquid container.
Figure 5:
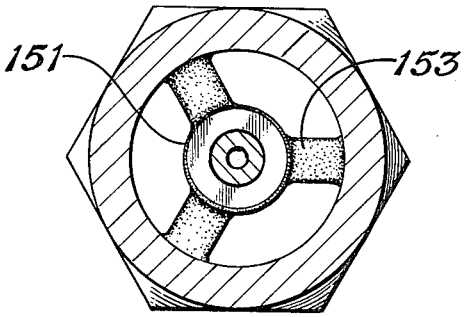
FIG. 5 is a cross-section of FIG. 4 taken along the lines 5—5 thereof.
Figure 6:
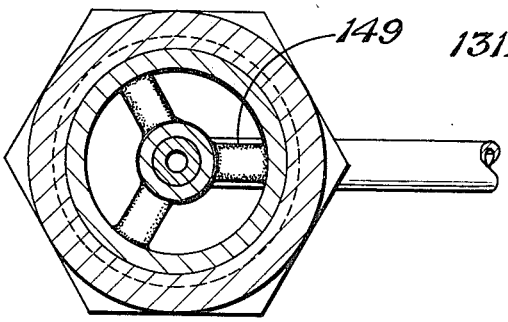
FIG. 6 is a cross-section of FIG. 4 taken along the lines 6—6 thereof.
Figure 4:
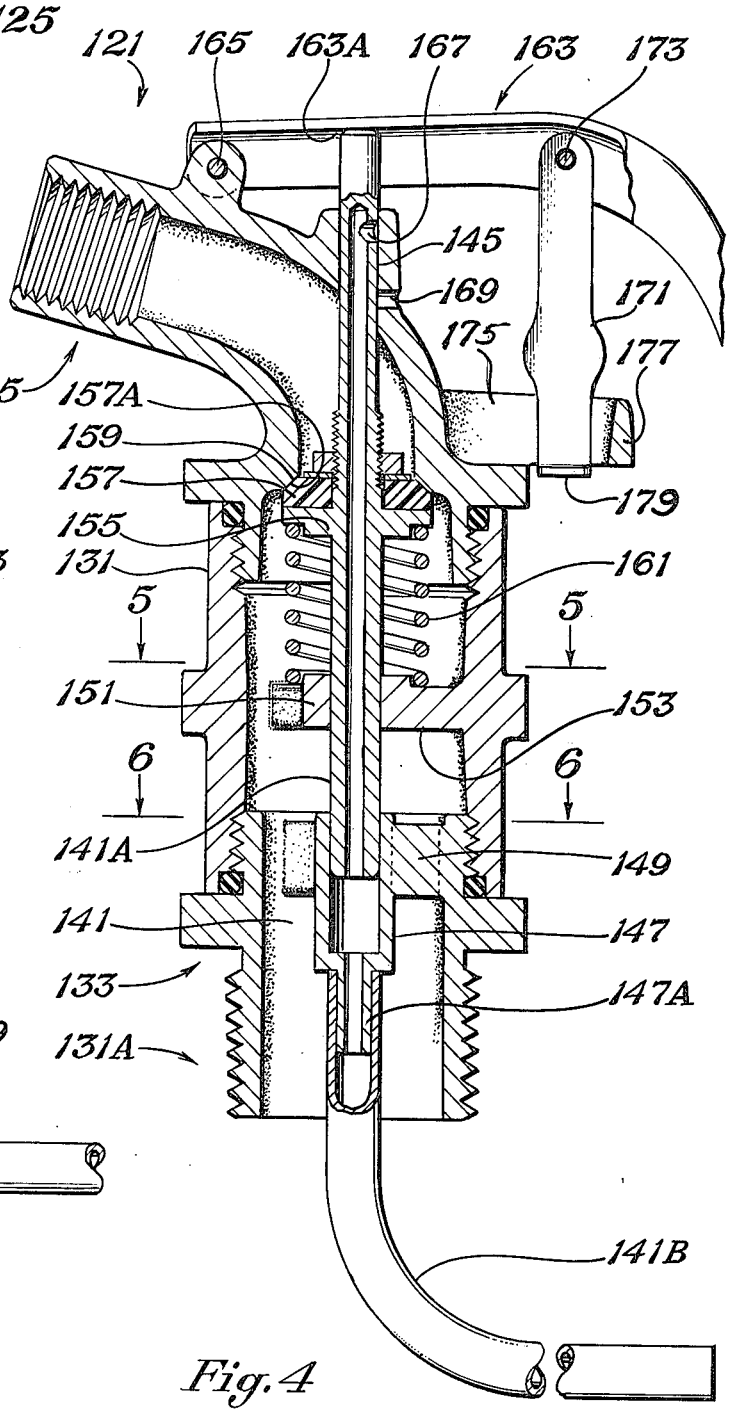
FIG. 4 is a cross-sectional side view of the spout of FIG. 3.

Referring now to FIGS. 3–6, there will be described another embodiment of the dispensisng spout of the present invention. The spout of this embodiment is identified by reference numeral 121 and preferably is used on larger can or containers such as 5 gallon cans or 55 gallon drums, the latter of which preferably are supported on their sides. In FIG. 3, the spout 121 is shown coupled to a female opening 123 formed in the top 127 of a 5 gallon can 125.

The spout 121 comprises a conduit 131 having an end 133 adapted to be coupled to the opening 123 and an opposite dispensing end 135. End 133 comprises a fitting 131A threaded to conduit 131 and having a threaded male end adapted to be threaded into the female threads of the opening 123.

The spout 121 includes a vent tube 141 having a movable portion 141A located in the conduit 131 and a second portion 141B extending out of the conduit 131 such that it may be located in the container when the spout is coupled in place to the container. The portion 141A is supported for reciprocal movement along the axis of a portion of the conduit 131 and has an upper portion which extends through an aperture 145 out of the conduit 131 and a lower portion which telescopes in tube member 147. Tube member 147 is fixedly attached to the inside of conduit 131 by spaced support members 149. Tube portion 141A also is supported for sliding movement in member 151 which is fixedly attached to the inside of conduit 131 by spaced support members 153. Vent tube portion 141B has its upper end coupled to portion 147A of tube member 147 in a slip joint arrangement. The vent tube portion 141B extends generally transverse to the vent tube portion 141A, preferably forming an acute angle thereto similar to tube portions 41A and 41B of the vent tube 41 of the embodiment of FIGS. 1 and 2. Tube portion 147A can be rotated inside of the vent tube portion 141B to allow conduit 131 to be threaded into the opening 123 of the container. In a can similar to that identified at 125, the outward end of tubular portion 141B will bear against the inside wall of the can and will not rotate as the member 131 is threaded into the opening 123.

Tube portion 141A has an annular integral flange 155 which supports an annular resilient or flexible seal member 157 having a surface 157A adapted to engage or seat against an annular mating surface 159 formed on the inside wall of conduit 131. A spring 161 is seated against member 151 and member 155 to normally urge member 155 and hence seal 157 against the surface 159 thereby normally closing the conduit 131. A trigger member 163 is pivotally coupled to the top portion of conduit 131 by a pivot pin 165. When the lower end of the trigger member 163 is depressed, the surface 163A engages the top portion of tubular member 141A and moves it downward thereby moving the seal 157 away from surface 159 to open the conduit 131 to the flow of liquid from the container. When the trigger member 163 is depressed far enough, aperture 167 formed in vent tube member 141A will line up with aperture 169 formed in conduit 131, thereby allowing air to flow into the vent tube 141 to facilitate the dispensing of liquid from the container in the same manner as does the vent tube 41 of the spout 21 of FIGS. 1 and 2. The open end of the vent tube portion 141B preferably will extend close to the top portion of the container when it is in the dispensing position to enhance the smooth dispensement of the liquid. When the trigger member 163 is released, the spring 161 moves the seal 157 to a closed position and the wall of the tubular portion 141A blocks the flow of air through aperture 169. A linkage 171 is pivotally coupled to trigger member 163 by pivot pin 173. The lower end of the linkage 171 extends through opening 175 formed in member 177 the latter of which extends from conduit 131. Linkage 171 includes a cross-member 179 at its lower end which is adapted to engage member 177 to limit the upward movement of the trigger member 163.

Referring now to the embodiment of FIGS. 7–10 the spout comprises a conduit 231 having a threaded female end 233 adapted to be coupled to the male opening 235 of a can 237, and an opposite dispensing end 239. The conduit 231 may have a threaded male end for attachment to the can if its opening is a threaded female opening. Also provided is a removable vent tube 241 and two types of removable lids 243 and 245.

The vent tube 241 includes an upper portion 241A fixedly attached to the inside wall 247 of a tube 249 which is adapted to loosely fit inside of the conduit 231 as shown in FIG. 9. A flexible O-ring 250 is provided to form a seal between the tube 249 and the conduit 231. Attached to the lower end of the tube 249 is a screen 251 which acts as a flame arrester. The lower portion 241B of the tube 241 extends through the screen and out of the conduit 231 such that it may be located in the can when the spout is coupled in place to the can as shown in FIG. 9.

Vent tube portion 241B extends transverse to vent tube portion 241A, preferably forming an acute angle therewith such that its opening 241D will be located close to the top of the can 237 when the conduit 231 is threaded in place. As mentioned above, the tube 249 fits loosely within the conduit 231 thereby allowing the conduit 231 to rotate relative to the tube 249 and hence relative to the vent tube 241. When the vent tube 241 is inserted in the can, its end will bear against the inside wall of the can whereby the vent tube 241 will not rotate as the conduit 231 is threaded into the opening 235.

The lid 243 is employed when the can 237 is in use whereas the lids 245 is employed when the can 237 is to be stored for long periods of time. Lid 243 will be described first. It comprises two members 255 and 257 pivotally coupled together by a pivot pin 259. Attached to the lower end of member 257 is a spring clip 261 adapted to be press fitted into an annular slot 263 formed in the lower end 233 of conduit 231 for attaching the lid 243 to the conduit as seen in FIG. 7. Secured to the lower side of member 255 at end 255A is a cap 265 having attached thereto a plastic conical shaped seal 267 adapted to engage a mating surface 269 formed in the dispensing end 239 of the conduit 231. A coil spring 271 is fitted around pivot pin 259 and has ends 271A and 271B which engage members 255 and 257 respectively and urge spring clip 261 and cap 265 toward each other. Thus when the spring clip 261 attaches the lid 243 to the conduit 231, spring 271 urges the seal 267 of the cap 265 against the seating surface 269 of the conduit 231 to close the dispensing end of the conduit. If pressure builds up in the can to a certain level the cap 265 will be forced up against the bias of the spring 271, to release the pressure.

In use, the member 255 may be located to extend over the handle 237A of the can. When it is desired to dispense liquid from the can, the can is titled and end 255B of member 255 depressed to move the cap 265 and seal 267 away from the dispensing end 239 of the conduit 231. Air will flow into the vent tube 241 through its upper opening 241C and into the can through opening 241D to facilitate dispensing of the liquid from the container in the same manner as does the vent tube 41 of the spout 21 of FIGS. 1 and 2. Since the opening 241C of vent tube 241 is located in the position shown in FIG. 9 when the conduit 231 is secured in place, the opening 241C will be above the liquid in the conduit 231 as it is dispensed when the can and hence the conduit 231 are titled for dispensing purposes. Thus the liquid flowing out of the conduit 231 will not interfere with the flow of air into the vent tube through its opening 241C.

When it is desired to store the can with its contents, the lid 243 may be removed by pulling the spring clip 261 out of the slot 263 and by attaching the lid 245 to the conduit 231. Lid 245 comprises a cup shaped member adapted to fit over the conduit 231 and to be secured thereto by movable arms 281. Arms 281 are pivotally coupled to the lid 245 by pivot pins 283. The arms 281 have enlarged portions 285. These enlarged portions are adapted to fit in annular groove 287 formed in the conduit 231, when the arms are moved to the upward position as shown in FIGS. 9 and 10, for clamping the lid 245 to the conduit 231. Resilient member 289 forms a seal between the conduit 231 and the lid 245. When it is desired to remove the lid 245, the arms 281 are moved downward to remove the enlarged portions 285 from the groove 287. Lid 245 then may be lifted off of the conduit 231.

Although not shown flame arrester screens may be employed in the embodiments of FIGS. 1, 2 and 3–6.

I claim:

1. A dispensing spout adapted to be removably coupled to the opening of a container for holding liquid, comprising:

conduit means having a threaded end adapted to be threaded to threaded means defining the opening of a container and having a dispensing end opposite said threaded end, tube means adapted to be located concentrically in said conduit means, screen means forming a flame arrester connected to the lower end of said tube means, a vent tube extending through said screen means and having a first portion located within said tube means next to its wall, said vent tube having a second portion adapted to extend out of said threaded end of said conduit means when said tube means and said first portion of said vent tube are located therein with said second portion of said vent tube being adapted to be located in the container when said threaded end of said conduit means is threaded to the threaded means defining the opening of the container, said second portion of said vent tube extending generally transverse to said first portion and having an end adapted to be located in the container at a position spaced away from the opening of the container, said tube means, said screen means, and said vent tube being fixedly secured relative to each other, said conduit means being rotatable relative to said tube means, said screen means and said vent tube.

2. The dispensing spout of claim 1 comprising the combination therewith of lid means adapted to be removably coupled to said conduit means for closing said dispensing end.

3. The combination of claim 2 comprising: annular means formed around the exterior of said conduit means, and holding means coupled to said lid means adapted to be coupled to said annular means for securing said lid means to said conduit means and adapted to be removed from said annular means for separating said lid means from said conduit means.

4. The combination of claim 2, comprising:

an annular slot formed around the exterior of said conduit means, said lid means comprising:

structure including spring clip means adapted to be located in said slot for securing said structure to said conduit means and adapted to be removed from said slot for detaching said structure from said conduit means, lever means pivotally coupled to said structure, closure means coupled to said lever means for closing said dispensing end of said conduit means when said closure means is located in a closed position, said lever means being adapted to move said closure means away from said closed position for opening said dispensing end of said conduit means, and spring means coupled between said structure and said lever means normally urging said lever means in a direction to normally cause said closure means to be located in said closed position when said spring clip means of said structure is located in said slot.

5. The combination of claim 2 comprising:

an annular groove formed around the exterior of said conduit means, said lid means comprising:

a cup shaped member adapted to fit over said dispensing end of said conduit means, and clamp means pivotally coupled to said cup shaped member and adapted to be located in said groove for securing said cup shaped member to said conduit means and adapted to be removed from said groove for allowing said cup shaped means to be removed from said conduit means.

* * * * *